US007185448B2

(12) United States Patent
Schupbach

(10) Patent No.: US 7,185,448 B2
(45) Date of Patent: Mar. 6, 2007

(54) SHOE WITH INTERCHANGEABLE HEEL MEMBERS

(76) Inventor: Lori Ann Schupbach, 211 E. Papage Dr., Tempe, AZ (US) 85281

( * ) Notice: Subject to any disclaimer, the term of this patent is extended or adjusted under 35 U.S.C. 154(b) by 243 days.

(21) Appl. No.: 10/964,329

(22) Filed: Oct. 13, 2004

(65) Prior Publication Data

US 2006/0075662 A1 Apr. 13, 2006

(51) Int. Cl.
*A43B 3/24* (2006.01)

(52) U.S. Cl. ..... 36/42; 36/15; 36/100

(58) Field of Classification Search ..... 36/15, 36/42, 36 R, 36 A, 36 B, 36 C, 100, 101
See application file for complete search history.

(56) References Cited

U.S. PATENT DOCUMENTS 1,743,543 A * 1/1930 Gutierrez ..... 36/42
2,509,423 A * 5/1950 Cramer ..... 36/105
2,707,341 A * 5/1955 Romano ..... 36/34 R
2,728,151 A * 12/1955 Smith ..... 36/24.5
2,795,866 A * 6/1957 Perugia ..... 36/24.5
3,153,865 A * 10/1964 Steinbock ..... 36/24.5
3,318,025 A * 5/1967 Barriga ..... 36/30 R
3,608,213 A * 9/1971 Jensen ..... 36/34 R
3,646,497 A * 2/1972 Gillikin ..... 36/58.5
4,219,946 A 9/1980 Baum
4,670,996 A * 6/1987 Dill ..... 36/42
4,805,320 A * 2/1989 Goldenberg et al. ..... 36/42
5,133,138 A * 7/1992 Durcho ..... 36/36 R
5,309,651 A 5/1994 Handel
5,373,649 A * 12/1994 Choi ..... 36/42
5,410,820 A 5/1995 Goodman
5,524,365 A 6/1996 Goldenberg
5,675,916 A 10/1997 Lewis
5,692,322 A * 12/1997 Lombardino ..... 36/100
5,953,836 A 9/1999 Watt et al.
6,711,835 B1 * 3/2004 Militello ..... 36/42

* cited by examiner

*Primary Examiner*—Marie Patterson
(74) *Attorney, Agent, or Firm*—Dale J. Ream

(57) ABSTRACT

A shoe includes a sole member, at least one heel member, a front securing member, and optionally a forward tread member. Each heel member includes a column portion having a predetermined height and a blade portion having a predetermined slope. Each blade portion's slope corresponds to the respective column portion's height for providing a proper amount of arch support for a user's foot. The sole member has an arch region made of a flexible material that defines a sleeve for selectively receiving each respective blade portion. Each blade portion includes a flange extending longitudinally therealong, and the sleeve defines a complementary groove. When the sleeve receives a respective blade portion, the blade portion provides shape and structural support for the sole member. Means for releasably attaching the respective column portion to the sole member are utilized, and the front securing member may secure the sole member to the user's foot.

13 Claims, 7 Drawing Sheets

SHOE WITH INTERCHANGEABLE HEEL MEMBERS

BACKGROUND OF THE INVENTION

This invention relates generally to a shoe with interchangeable attachments. In particular, the present invention relates to a shoe with interchangeable heel members that include blade portions for providing shape and structural support for the sole of the shoe.

There are many reasons for a shoe with interchangeable heel members to be desirable to today's consumer. Women's shoes in particular are limited in usefulness based on heel height. A dress-style high heel and a casual flat heel may both be desirable, but each would be inappropriate for certain occasions. A compromise is usually made by purchasing multiple pairs of shoes for different situations. This often quickly becomes expensive, however. Further, when travelling or simply storing shoes, limited space is often an issue and restricts the number of accessible shoes. In cities with widespread public transportation, and especially those with subway systems, women often wear a pair of shoes with a flat heel on their journey to and from work and another pair of shoes with a larger heel while at work. To do this, they have to carry their work shoes to and from work. A single pair of shoes that can be easily converted to different heel heights would be a welcome solution to many of these problems.

Various proposals for shoes with interchangeable heels for varying the heel heights are found in the art. Such shoes are disclosed in U.S. Pat. Nos. 4,670,996; 5,133,138; 5,410,820; 5,524,365; 5,675,916; 5,953,836; and 6,711,835. While assumably effective for their intended purposes, the existing devices do not provide a shoe with interchangeable heel members that include blade portions for providing shape and structural support for the sole of the shoe. Shape and structural support are essential for a comfortable and attractive fit. Therefore, it would be desirable to have a shoe with interchangeable heel members having blade portions with predetermined slope.

SUMMARY OF THE INVENTION

A shoe according to the present invention includes a sole member, at least one heel member, a front securing member, and a rear restraining member. Each heel member includes a column portion having a predetermined height and a blade portion having a predetermined slope. The predetermined slope of each blade portion corresponds to the predetermined height of the respective column portion for providing a proper amount of arch support for a user's foot. The sole member has an arch region made of a flexible material that defines a sleeve for selectively receiving each respective blade portion. Each blade portion includes an elongate flange extending longitudinally therealong, and the sleeve defines a complementary groove extending longitudinally therein. The shoe also includes means for releasably attaching each respective column portion to the sole member, including a barbed fitting, a tooth, and a triggering mechanism. A forward tread member may also be included in the shoe.

In use, a respective blade portion is received in the sleeve. This causes the complementary flange and groove to form a tongue and groove relationship and the blade portion to provide shape and structural support for the sole member. The respective column portion is releasably attached to the sole member using the barbed fitting, the tooth, and the triggering mechanism. The front securing member and the rear restraining member may be used conventionally to secure the sole member to the user's foot.

Therefore, a general object of this invention is to provide a shoe that has interchangeable heel members.

Another object of this invention is to provide a shoe, as aforesaid, with interchangeable heel members having different heights.

Still another object of this invention is to provide a shoe, as aforesaid, with interchangeable heel members having different aesthetic designs.

Yet another object of this invention is to provide a shoe with interchangeable heel members, as aforesaid, that provides a proper amount of arch support for a user's foot, regardless of the heel height.

A further object of this invention is to provide a shoe with interchangeable heel members, as aforesaid, that is comfortable and safe to wear.

A still further object of this invention is to provide a shoe, as aforesaid, with heel members that can be easily interchanged.

An even further object of this invention is to provide a shoe with interchangeable heel members, as aforesaid, that is aesthetically pleasing.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1A:
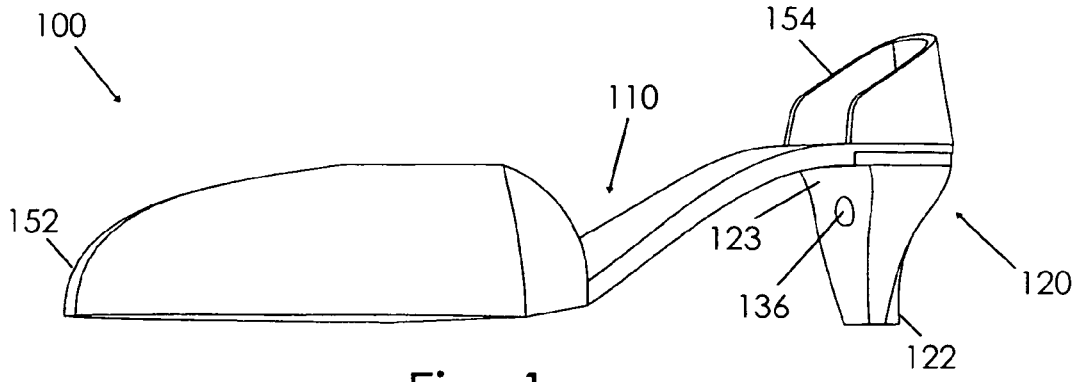
FIG. 1*a* is a perspective view of a shoe with interchangeable heel members according to the present invention.
Figure 1B:
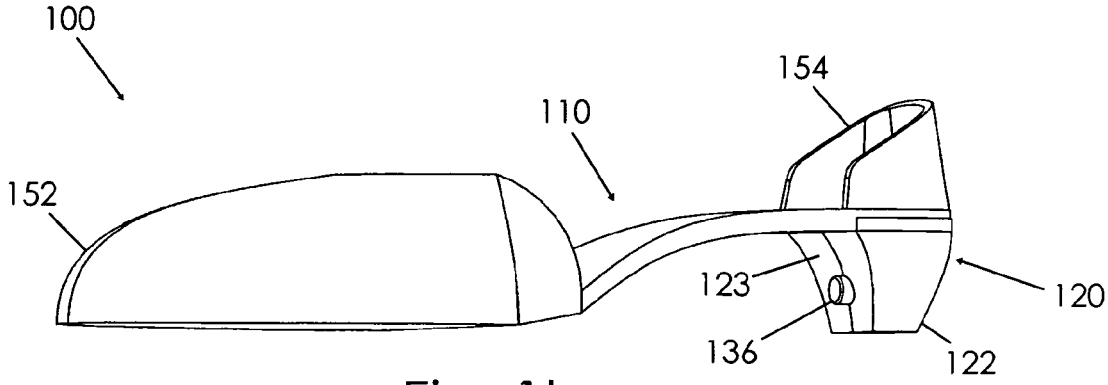
FIG. 1*b* is a perspective view of the shoe as in FIG. 1*a* with a second heel member attached to the sole member.
Figure 1C:
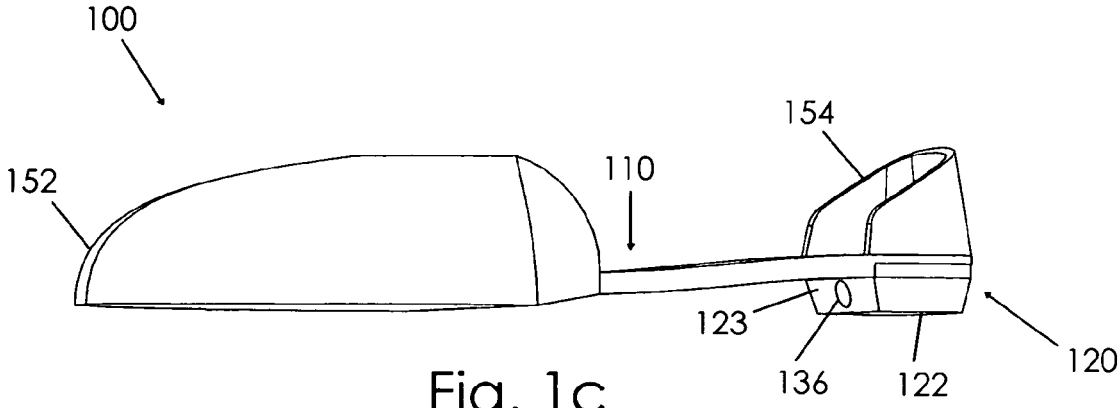
FIG. 1*c* is a perspective view of the shoe as in FIG. 1*a* with a third heel member attached to the sole member.
Figure 2A:
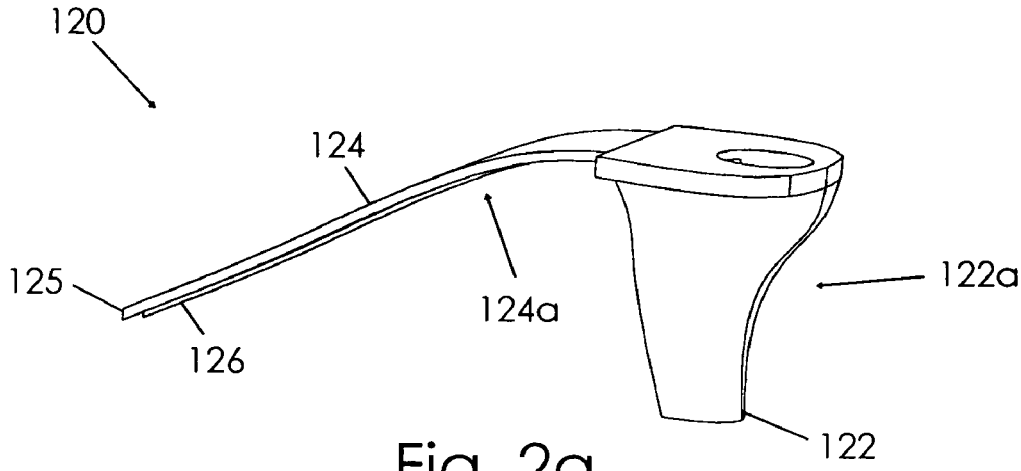
FIG. 2*a* is a perspective view of the first heel member as in FIG. 1*a;*
Figure 2B:
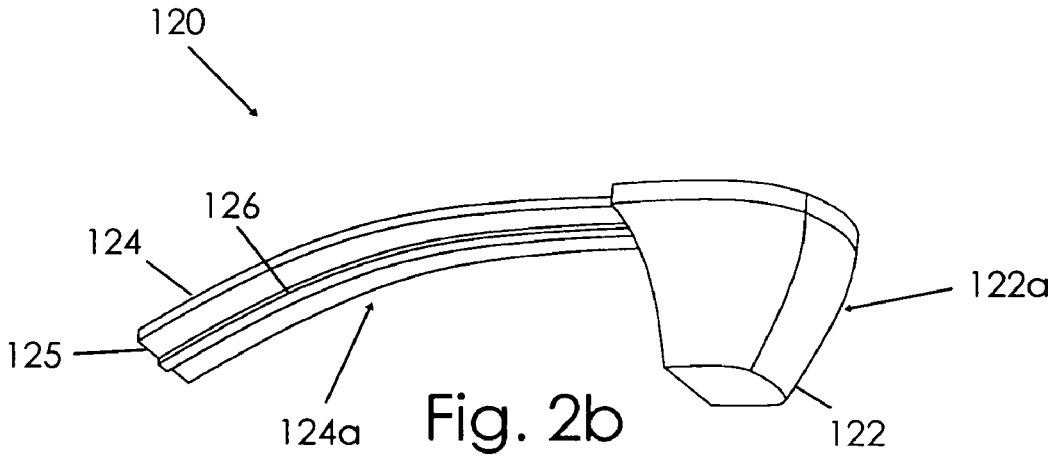
FIG. 2*b* is a perspective view of the second heel member as in FIG. 1*b;*
Figure 2C:
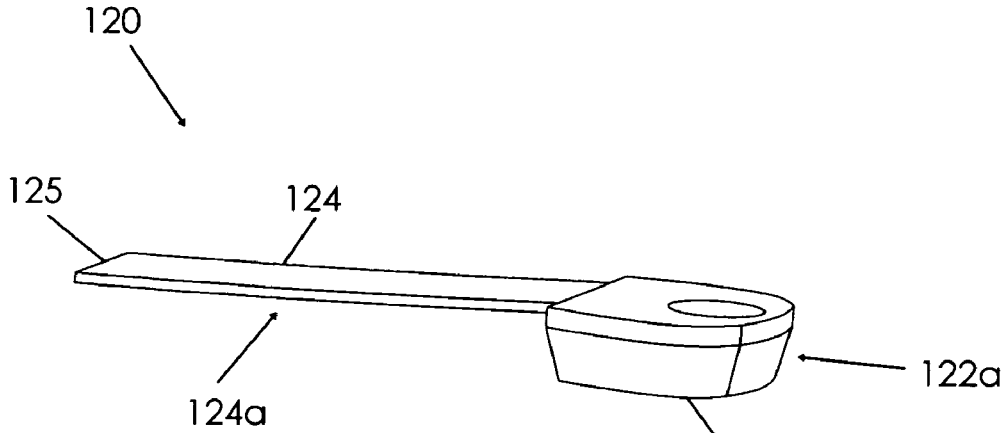
FIG. 2*c* is a perspective view of the third heel member as in FIG. 1*c;*

A shoe with interchangeable heel members according to the present invention will now be described in detail with reference to FIGS. 1*a* through 7*c* of the accompanying drawings. More particularly, a shoe 100 includes a sole member 110, a plurality of heel members 120, a front securing member 152, and a rear restraining member 154 (FIGS. 1*a* through 1*c*).

Figure 3A:
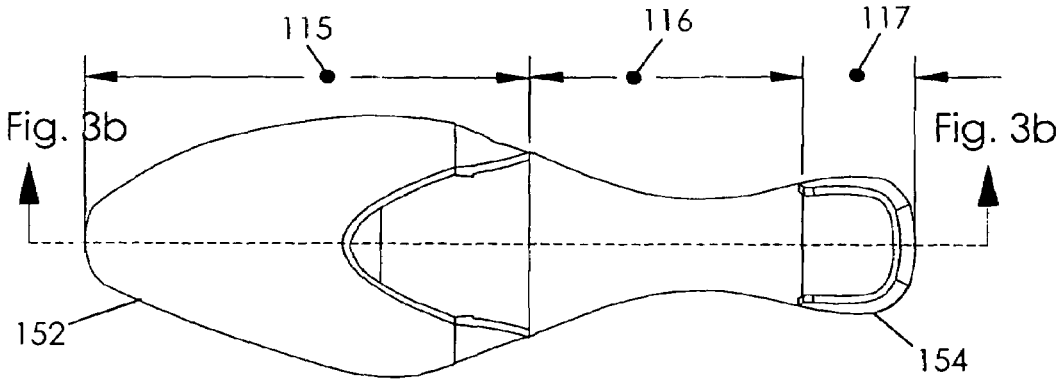
FIG. 3*a* is a top view of the shoe as in FIG. 1*a;*
Figure 3B:
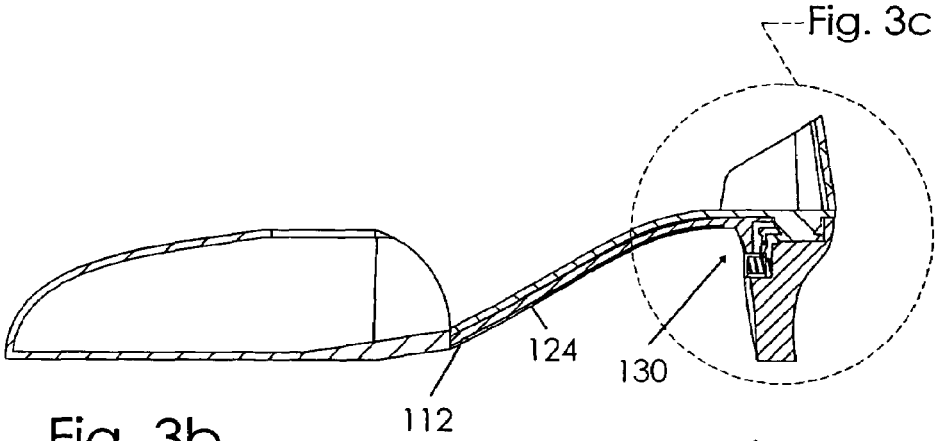
FIG. 3*b* is a sectional view of the shoe taken along line 3*b*—3*b* of FIG. 3*a;*
Figure 3C:
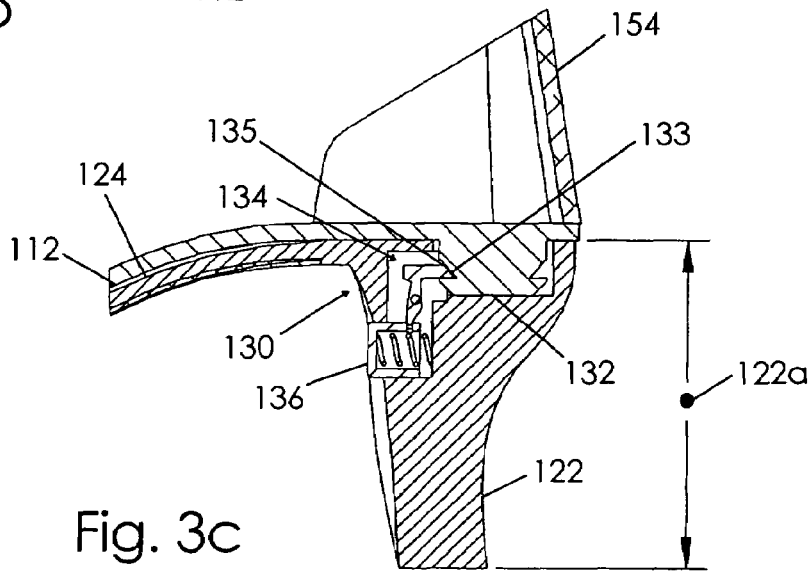
FIG. 3*c* is a sectional view on an enlarged scale showing the means for releasably attaching a column portion of a heel member to the sole member taken from FIG. 3*b;*

Each heel member 120 includes a column portion 122 having a predetermined height 122*a* and a blade portion 124 having a predetermined slope 124*a* and a free end 125 opposed from the column portion 122 (FIGS. 2*a* through 2*c* and FIG. 3*c*). The shoe 100 includes means 130 for releasably attaching each column portion 122 to the sole member 110 (FIGS. 3*b* and 3*c*). The predetermined slope 124*a* of each blade portion 124 corresponds to the predetermined height 122*a* of the respective column portion 122 for providing a proper amount of arch support for a user's foot. Each heel member 120 has a configuration different from a configuration of any other heel member 120. In other words, each heel member 120 differs in column portion height 122*a* or in aesthetic design. It must be appreciated, however, that it would be suitable for a pair of shoes 100 according to this invention to include two heel members 120 with identical column portion heights 122*a* and identical aesthetic designs.

The sole member 110 defines a sleeve 112 (FIG. 4*b*), and the sleeve 112 defines a configuration complementary to a configuration of each free end 125 for selectively receiving each free end 125, respectively. Preferably, each blade portion 124 includes an elongate flange 126 extending longitudinally therealong (FIGS. 2*a* and 2*b*), and the sleeve 112 defines a groove 113 extending longitudinally therein (FIG. 4*b*). The sleeve groove 113 has a configuration complementary to a configuration of each flange 126 such that each respective blade portion 124 is selectively received in the sleeve 112 in a tongue and groove relationship.

The sole member 110 has an arch region 116 situated between a toe region 115 and a rearward region 117 (FIG. 3*a*). The toe region 115 is constructed of a semi-flexible material for allowing the toe region 115 to selectively flex. The arch region 116 includes the sleeve 112 and is constructed of a flexible material for allowing the arch region 116 to conform to the predetermined slope 124*a* of the blade portion 124 when the sleeve 112 receives a respective blade portion 124. Each blade portion 124 is constructed of a rigid material for providing a predetermined form to the sole member arch region 116 when a respective blade portion 124 is inserted into the sleeve 112. In other words, the respective blade portion provides shape and structural support for the sole member 110 when inserted into the sleeve 112. The rearward region 117 is constructed of a substantially rigid material for allowing the rearward region 117 to fixedly engage the column portion 122 of each respective heel member 120. Though not shown, the sleeve 112 may extend into the toe region 115 of the sole member 110.

Figure 5A:
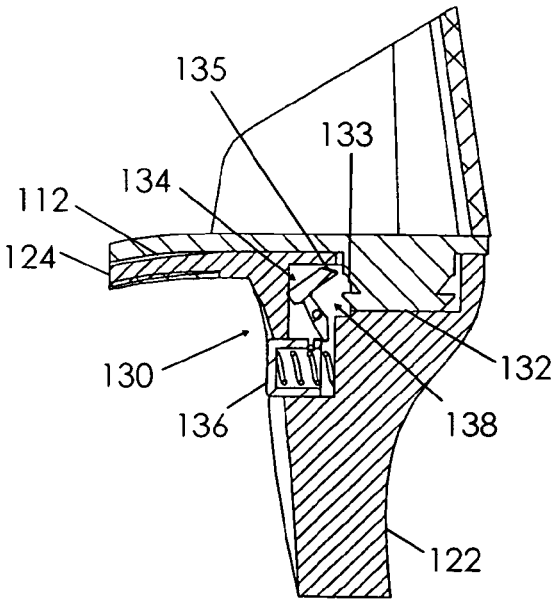
FIG. 5*a* is a sectional view on an enlarged scale showing the means for releasably attaching a column portion of a heel member to the sole member taken from FIG. 3*b* with the tooth in a locked position.
Figure 5B:
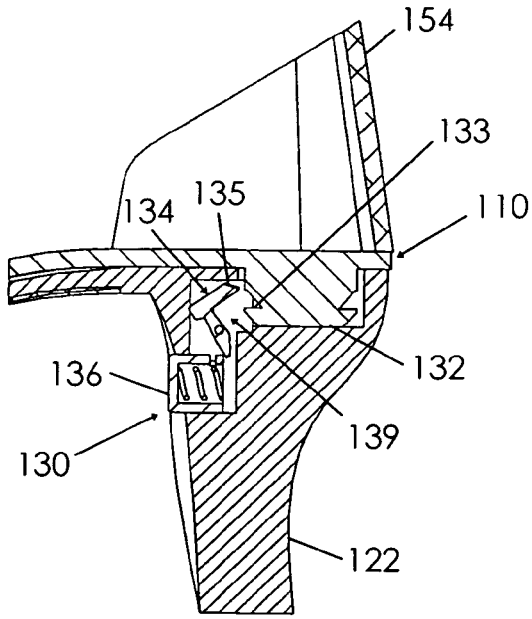
FIG. 5*b* is a sectional view on an enlarged scale showing the means for releasably attaching a column portion of a heel member to the sole member taken from FIG. 3*b* with the tooth in a free position.
Figure 5C:
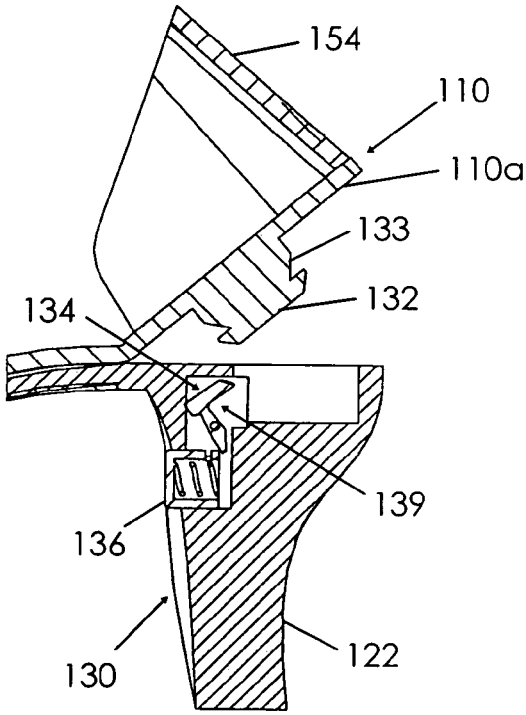
FIG. 5*c* is a sectional view on an enlarged scale showing the means for releasably attaching a column portion of a heel member to the sole member taken from FIG. 3*b* with the tooth in a free position and the rearward region of the sole member raised.

The means 130 for releasably attaching each column portion 122 to the sole member 110 includes a barbed fitting 132, a tooth 134 positioned within each column portion 122, and a triggering mechanism 136 positioned within each column portion 122 (FIG. 3*c* and FIGS. 5*a* through 5*c*). The barbed fitting 132 protrudes from a bottom surface 110*a* of the sole member 110 and defines a groove 133. Each tooth 134 has a configuration 135 complementary to a configuration of the barbed fitting groove 133 for selectively engaging the barbed fitting 132. Each triggering mechanism 136 is positioned in a respective column portion 122 for selectively moving a respective tooth 134 between a locked position 138 for engaging the barbed fitting 132 (FIG. 5*a*) and a free position 139 for releasing the barbed fitting 132 (FIGS. 5*b* and 5*c*). Although a button protruding from a front surface 123 of the column portion 122 (FIG. 1*a*) is preferred, other triggering mechanisms would also be suitable.

The front securing member 152 is connected to the sole member 110 for selectively securing the sole member 110 to a user's foot. Though shown throughout the drawings as a closed-toe design, the front securing member 152 may of course be straps or the like. The rear restraining member 154 is connected to the sole member 110 for selectively securing the sole member 110 to a user's foot, and specifically to a user's heel and/or ankle. Though shown throughout the drawings as a solid wall, the rear restraining member 154 may of course be straps or the like, and it is also possible for the rear restraining member 154 to be omitted.

It must be further appreciated that while a plurality of heel members 120 are preferably included in the present invention, they are not critical thereto. Rather, the current invention may be practiced using only one heel member 120. It is also noteworthy that just as multiple heel members 120 may be used with a single sole member 110, multiple sole members 110 may be used with a single heel member 120 or a single plurality of heel members 120.

Figure 4A:
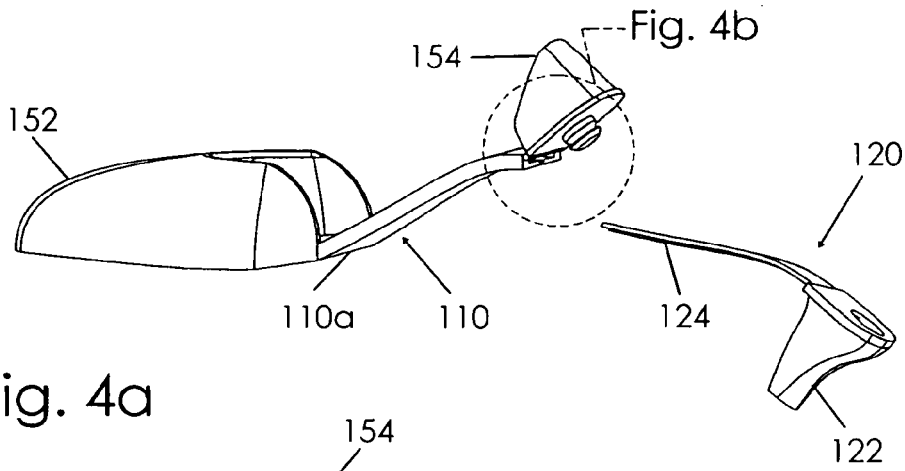
FIG. 4*a* is a perspective view of the shoe as in FIG. 1*a* with the sole member separated from a heel member.
Figure 4B:
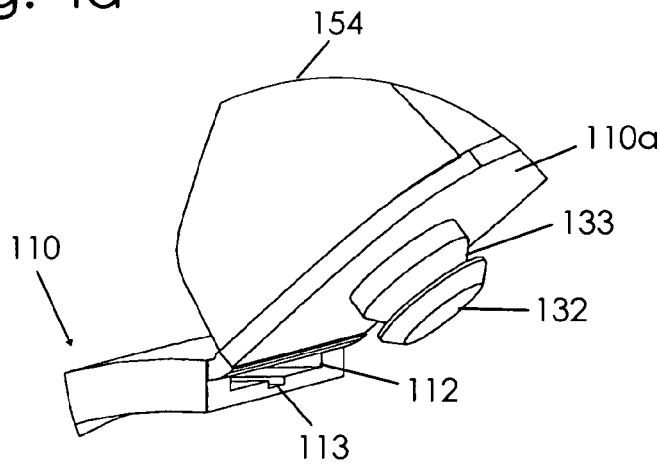
FIG. 4*b* is a partial perspective view on an enlarged scale showing the sleeve and the rearward region of the sole member taken from FIG. 4*a;*
Figure 4C:
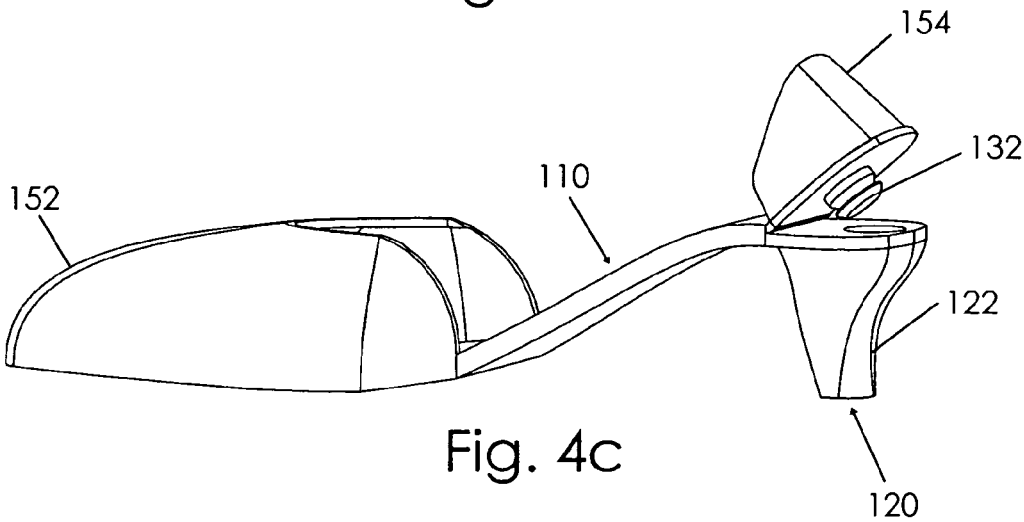
FIG. 4*c* is a perspective view of the shoe as in FIG. 1*a* with the sole member partially attached to a heel member.

In use, the sole member 110 is initially separate from all heel members 120 (FIG. 4*a*). A heel member 120 is chosen, and the rearward region 117 of the sole member 110 is raised so the barbed fitting 132 does not obstruct the sleeve 112 (FIG. 4*b*). The blade portion 124 of the chosen heel member 120 is inserted into the sleeve 112 with the free end 125 entering the sleeve 112 first (FIG. 4*c*). The blade portion 124 is received in the sleeve 112 in a tongue and groove relationship, and the blade portion 124 provides a predetermined form to the sole member arch region 116 to provide a proper amount of arch support for a user's foot. After the blade portion 124 is inserted into the sleeve 112, the rearward region 117 is lowered, causing the tooth 134 to engage the barbed fitting 132 at the barbed fitting groove 133 (FIG. 5*a*). This engagement locks the rearward region 117 of the sole member 110 to the column portion 122 of the heel member 120. The front securing member 152 and the rear restraining member 154 may then be used conventionally to secure the sole member 110 to the user's foot.

To remove the heel member 120 from the sole member 110, the triggering mechanism 136 is activated, moving the tooth 134 from the locked position 138 (FIG. 5*a*) to the free position 139 (FIG. 5*b*). This causes the tooth 134 to disengage the barbed fitting 132 (FIG. 5*b*). The rearward region 117 of the sole member 110 may then be raised, separating the heel member column portion 122 from the rearward region 117 (FIG. 5*c*). The blade portion 124 may then be removed from the sleeve 112 with the free end 125 exiting the sleeve 112 last.

Figure 6:
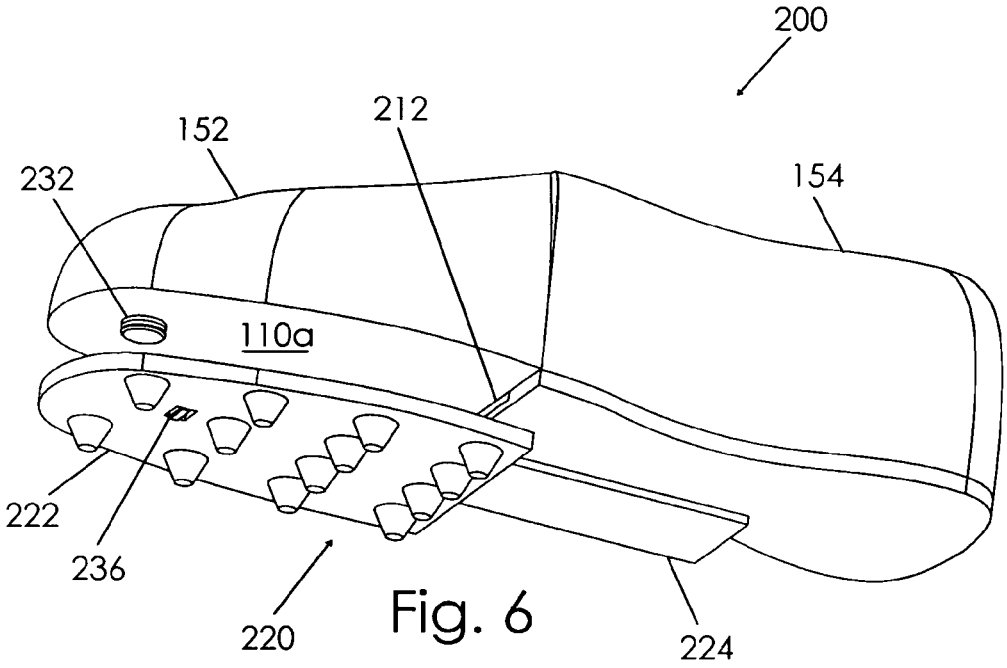
FIG. 6 is an exploded view of a shoe according to another embodiment of the present invention.
Figure 7A:
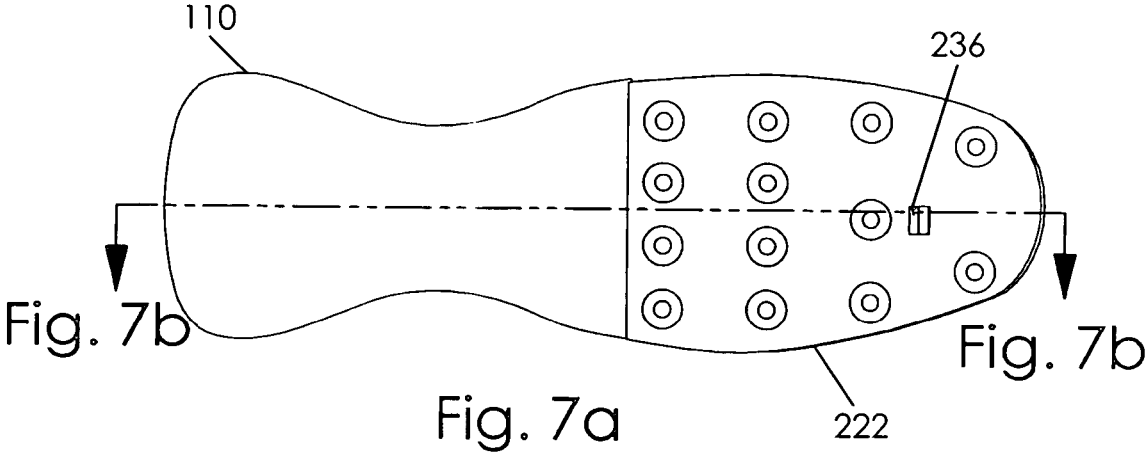
FIG. 7*a* is a bottom view of the shoe as in FIG. 6.
Figure 7B:
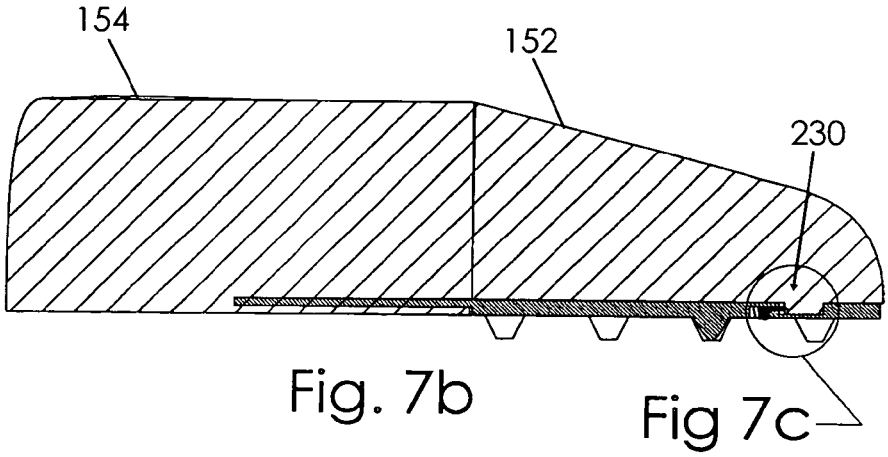
FIG. 7*b* is a sectional view of the shoe taken along line 7*b*—7*b* of FIG. 7*a*.
Figure 7C:
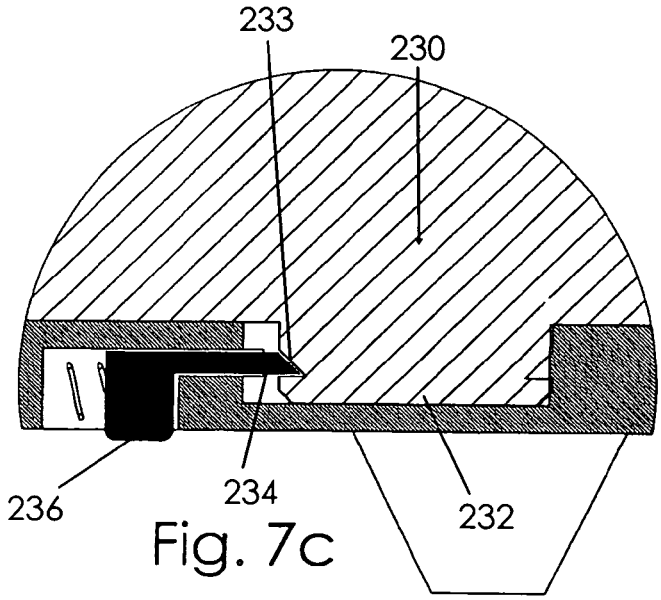
FIG. 7*c* is a sectional view on an enlarged scale showing the means for releasably attaching a tread portion of a forward tread member to the sole member taken from FIG. 7*b*.

A shoe 200 according to another embodiment of the present invention is shown in FIGS. 6 through 7*c* and includes a construction substantially similar to the construction previously described except as specifically noted below. More particularly, the shoe 200 includes at least one forward tread member 220, and the sole member 110 defines a forward sleeve 212 (FIG. 6). Each forward tread member 220 includes a tread portion 222 and a forward blade portion 224 extending from the tread portion 222. The forward sleeve 212 has a configuration complementary to a configuration of each forward blade portion 224 for selectively receiving each forward blade portion 224, respectively. Means 230 are included for releasably attaching the tread portion 222 to the sole member 110 (FIGS. 7*b* and 7*c*). Preferably, a second barbed fitting 232 protrudes from the bottom surface 110*a* of the sole member 110 and defines a groove 233. A forward tooth 234 is positioned in the tread portion 222 of each forward tread member 220. Each forward tooth 234 has a configuration complementary to a configuration of the second barbed fitting groove 233 for selectively engaging the second barbed fitting 232, respectively. A second triggering mechanism 236 selectively disengages the forward tooth 234 from the second barbed fitting groove 233.

In use, the sole member 110 is initially separate from all forward tread members 220 (FIG. 6). The forward blade portion 224 is inserted into the forward sleeve 212, and the forward tooth 234 engages the second barbed fitting groove 233, securing the forward tread member to the sole member 110 (FIGS. 7*a* through 7*c*). To remove the forward tread member 220 from the sole member 110, the second triggering mechanism 236 is activated, causing the forward tooth 234 to disengage the second barbed fitting groove 233. The forward blade portion 224 may then be pulled from the forward sleeve 212, separating the forward tread member 220 and the sole member 110.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A shoe, comprising:

a heel member including a column portion having a predetermined height and a blade portion having a predetermined slope and a free end opposed from said column portion;

a sole member defining a sleeve, said sleeve defining a configuration complementary to a configuration of said free end for selectively receiving said free end; and means for releasably attaching said column portion of said heel member to said sole member;

wherein said means for attaching said column portion of said heel member to said sole member includes:

a barbed fitting protruding from a bottom surface of said sole member and defining a groove; and a tooth positioned within said column portion of said heel member and having a configuration complementary to a configuration of said barbed fitting groove for selectively engaging said barbed fitting;

a forward tread member including a tread portion and a forward blade portion extending from said tread portion;

wherein said sole member defines a forward sleeve having a configuration complementary to a configuration of said forward blade portion for selectively receiving said forward blade portion;

a second barbed fitting protruding from said bottom surface of said sole member and defining a groove; and a forward tooth positioning in said tread portion of said forward tread member and having a configuration complementary to a configuration of said second barbed fitting groove for selectively engaging said second barbed fitting.

2. The shoe as in claim 1, wherein said column portion of said heel member includes a triggering mechanism for selectively moving said tooth between a locked position for engaging said barbed fitting and a free position for releasing said barbed fitting.

3. The shoe as in claim 1, wherein:

said blade portion of said heel member includes an elongate flange extending longitudinally therealong; and said sleeve defines a groove extending longitudinally therein, said groove having a configuration complementary to a configuration of said flange such that said blade portion is selectively received in said sleeve in a tongue and groove relationship.

4. The shoe as in claim 1, wherein:

said blade portion is constructed of a rigid material for providing a predetermined form to said sole member when said blade portion is inserted into said sleeve;

said sole member includes an arch region situated between a toe region and a rearward region; and said arch region includes said sleeve.

5. The shoe as in claim 4, wherein said arch region of said sole member is constructed of a flexible material for allowing said arch region to conform to said predetermined slope of said blade portion when said sleeve receives said blade portion.

6. The shoe as in claim 4, wherein:

said rearward region of said sole member is constructed of a rigid material for allowing said rearward region to fixedly engage said column portion of said heel member; and said toe region of said sole member is constructed of a semi-flexible material for allowing said toe region to selectively flex.

7. The shoe as in claim 1, further comprising a front securing member connected to said sole member for selectively securing said sole member to a user's foot.

8. The shoe as in claim 1, further comprising a rear restraining member connected to said sole member for selectively securing said sole member to a user's foot.

9. The shoe as in claim 1, further comprising a plurality of heel members, and wherein:

each heel member includes a column portion and a blade portion and has a configuration different from a configuration of any other heel member;

each column portion has a predetermined height; and each blade portion has a predetermined slope.

10. The shoe as in claim 9, wherein said sleeve configuration of said sole member is complementary to a configuration of each blade portion free end for selectively receiving each blade portion free end, respectively.

11. The shoe as in claim 1, further comprising:

a forward tread member including a tread portion and a forward blade portion extending from said tread portion;

wherein said sole member defines a forward sleeve having a configuration complementary to a configuration of said forward blade portion for selectively receiving said forward blade portion; and means for releasably attaching said tread portion of said forward tread member to said sole member.

12. A shoe, comprising:

a sole member defining a sleeve;

a plurality of heel members, each heel member including a column portion and a blade portion and having a configuration different from a configuration of any other heel member, each column portion having a predetermined height, each blade portion having a free end opposed from said column portion and a predetermined slope for providing shape and structural support for said sole member;

means for releasably attaching each heel member to said sole member, respectively;

a front securing member connected to said sole member for selectively securing said sole member to a user's foot;

wherein said sleeve defines a configuration complementary to a configuration of each blade portion free end for selectively receiving each blade portion free end, respectively;

wherein each blade portion includes an elongate flange extending longitudinally therealong;

wherein said sleeve defines a groove extending longitudinally therein, said sleeve groove having a configuration complementary to a configuration of each flange such that each respective blade portion is selectively received in said sleeve in a tongue and groove relationship;

wherein said means for releasably attaching each heel member to said sole member includes:

a barbed fitting protruding from a bottom surface of said sole member and defining a groove;

a tooth positioned within said column portion of each heel member and having a configuration complementary to a configuration of said barbed fitting groove for selectively engaging said barbed fitting;

a triggering mechanism positioned in said column portion of each heel member for selectively moving said respective tooth between a locked position for engaging said barbed fitting and a free position for releasing said barbed fitting;

a plurality of forward tread members, each forward tread member including a tread portion and a forward blade portion extending from said tread portion;

wherein said sole member defines a forward sleeve having a configuration complementary to a configuration of each forward blade portion for selectively receiving each forward blade portion, respectively;

a second barbed fitting protruding from said bottom surface of said sole member and defining a groove; and a forward tooth positioned in said tread portion of each forward tread member and having a configuration complementary to a configuration of said second barbed fitting groove for selectively engaging said second barbed fitting, respectively.

13. The shoe as in claim 12 wherein:

each blade portion is constructed of a rigid material for providing a predetermined form to said sole member when said blade portion is inserted into said sleeve;

said sole member has an arch region situated between a toe region and a rearward region;

said arch region includes said sleeve and is constructed of a flexible material for allowing said arch region to conform to said predetermined slope of said blade portion when said sleeve receives said respective blade portion; and said rearward region is constructed of a rigid material for allowing said rearward region to fixedly engage said column portion of each respective heel member.

* * * * *